US006772837B2

(12) United States Patent
Dusterhoft et al.

(10) Patent No.: US 6,772,837 B2
(45) Date of Patent: Aug. 10, 2004

(54) SCREEN ASSEMBLY HAVING DIVERTER MEMBERS AND METHOD FOR PROGRESSIVELY TREATING AN INTERVAL OF A WELIBORE

(75) Inventors: Ronald G. Dusterhoft, Katy, TX (US); Syed Hamid, Dallas, TX (US); Roger L. Schultz, Aubrey, TX (US); Robert Ken Michael, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/012,856

(22) Filed: Oct. 22, 2001

(65) Prior Publication Data

US 2003/0075324 A1 Apr. 24, 2003

(51) Int. Cl.[7] ..... E21B 43/04
(52) U.S. Cl. ..... 166/278; 166/51
(58) Field of Search ..... 166/242.3, 376, 166/278, 51, 317, 386, 236, 157, 316

(56) References Cited

U.S. PATENT DOCUMENTS

| | | | |
|---|---|---|---|
| 1,975,162 A | 10/1934 | Layne | |
| 2,342,913 A | 2/1944 | Williams et al. | |
| 2,344,909 A | 3/1944 | Williams et al. | |
| 4,102,395 A | 7/1978 | Robinson | |

(List continued on next page.)

FOREIGN PATENT DOCUMENTS

| | | | |
|---|---|---|---|
| EP | 1 132 571 | 9/2001 | ..... E21B/43/267 |
| WO | WO 99/12630 | 3/1999 | ..... B01D/29/15 |
| WO | WO 00/61913 | 10/2000 | ..... E21B/43/04 |
| WO | WO 01/14691 | 3/2001 | ..... E21B/43/08 |
| WO | WO 01/44619 | 6/2001 | ..... E21B/43/04 |
| WO | WO 02/10554 | 2/2002 | ..... E21B/43/26 |

OTHER PUBLICATIONS

"Mechanical Fluid–Loss Control Systems Used During Sand Control Operations," H.L. Restarick of Otis Engineering Corp., 1992.
"Sand Control Screens," Halliburton Energy Services, 1994.
"Frac Pack Technology Still Evolving," Charles D. Ebinger of Ely & Associates Inc.; Oil & Gas Journal, Oct. 23, 1995.
"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.
"Caps$^{SM}$ Sand Control Service for Horizontal Completions Improves Gravel Pack Reliability and Increases Production Potential from Horizontal Completions," Halliburton Energy Services, Inc., Aug., 2000.
"Caps$^{SM}$ Concentric Annular Packing Service for Sand Control," Halliburton Energy Services, Inc., Aug., 2000.
"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

*Primary Examiner*—David Bagnell
*Assistant Examiner*—Daniel P Stephenson
(74) *Attorney, Agent, or Firm*—Lawrence R. Youst

(57) ABSTRACT

A screen assembly (38) and method for progressively treating an interval (48) of a wellbore (32) is disclosed. The screen assembly (38) comprises a sand control screen (40) that is positioned within the wellbore (32) and a plurality of diverter members (42) that are positioned along the sand control screen (40). During a treatment process when a treatment fluid is pumped into the interior of the sand control screen (40), the diverter members (42) progressively allow the treatment fluid to exit from the interior of the sand control screen (40) to the exterior of the sand control screen (40) from a first end (46) of the interval (48) to a second end (44) of the interval (48) to progressively treat the interval (48) of the wellbore (32).

64 Claims, 7 Drawing Sheets

U.S. PATENT DOCUMENTS 4,558,742 A 12/1985 Huang et al.
4,932,474 A * 6/1990 Schroeder et al. ..... 166/278
4,945,991 A 8/1990 Jones ..... 166/278
5,082,052 A 1/1992 Jones et al. ..... 166/51
5,113,935 A 5/1992 Jones et al. ..... 166/51
5,161,613 A 11/1992 Jones ..... 166/242
5,161,618 A 11/1992 Jones et al. ..... 166/308
5,165,476 A 11/1992 Jones
5,333,688 A 8/1994 Jones et al. ..... 166/278
5,355,956 A 10/1994 Restarick ..... 166/296
5,390,966 A 2/1995 Cox et al. ..... 285/137.1
5,419,394 A 5/1995 Jones ..... 166/51
5,443,117 A 8/1995 Ross ..... 166/51
5,476,143 A 12/1995 Sparlin et al. ..... 166/233
5,515,915 A 5/1996 Jones et al. ..... 166/51
5,588,487 A 12/1996 Bryant ..... 166/51
5,636,691 A 6/1997 Hendrickson et al. ..... 166/278
5,755,286 A 5/1998 Ebinger ..... 166/281
5,842,516 A 12/1998 Jones ..... 166/56
5,848,645 A 12/1998 Jones ..... 166/280
5,868,200 A 2/1999 Bryant et al. ..... 166/51
5,890,533 A 4/1999 Jones ..... 166/51
5,921,318 A 7/1999 Ross ..... 166/250.17
5,934,376 A 8/1999 Nguyen et al. ..... 166/278
6,003,600 A 12/1999 Nguyen et al. ..... 166/281
6,047,773 A 4/2000 Zeltmann et al. ..... 166/281
6,059,032 A 5/2000 Jones ..... 166/278
6,116,343 A 9/2000 Van Petegem et al. ..... 166/297
6,125,933 A 10/2000 Ross ..... 166/250.01
6,220,345 B1 4/2001 Jones et al. ..... 166/51
6,227,303 B1 5/2001 Jones ..... 166/378
6,230,803 B1 5/2001 Morton et al. ..... 166/278
6,343,651 B1 2/2002 Bixenman ..... 166/278
6,450,263 B1 * 9/2002 Schwendemann ..... 166/373
6,464,007 B1 * 10/2002 Jones ..... 166/279
6,516,881 B2 2/2003 Hailey, Jr.
6,516,882 B2 2/2003 McGregor et al.
6,557,634 B2 5/2003 Hailey, Jr. et al.
6,581,689 B2 6/2003 Hailey, Jr.
6,588,506 B2 7/2003 Jones
6,588,507 B2 7/2003 Dusterhoft et al.

* cited by examiner

SCREEN ASSEMBLY HAVING DIVERTER MEMBERS AND METHOD FOR PROGRESSIVELY TREATING AN INTERVAL OF A WELIBORE

TECHNICAL FIELD OF THE INVENTION

This invention relates, in general, to the treatment of a production interval of a wellbore to stimulate hydrocarbon production and prevent the production of fine particulate materials and, in particular, to a screen assembly having diverter members and a method for progressively gravel packing or progressively frac packing the production interval of the wellbore.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants which are typically sized and graded and which are typically referred to herein as gravel, is then pumped down the work string and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It is sometimes desirable to perform a formation fracturing and propping operation prior to or simultaneously with the gravel packing operation. Hydraulic fracturing of a hydrocarbon formation is sometimes necessary to increase the permeability of the production interval adjacent the wellbore. According to conventional practice, a fracture fluid such as water, oil, oil/water emulsion, gelled water, gelled oil, $CO_2$ and nitrogen foams or water/alcohol mixture is pumped down the work string with sufficient volume and pressure to open multiple fractures in the production interval. The fracture fluid may carry a suitable propping agent, such as sand, gravel or proppants, which are typically referred to herein as proppants, into the fractures for the purpose of holding the fractures open following the fracturing operation.

The fracture fluid must be forced into the formation at a flow rate great enough to generated the required pressure to fracture the formation allowing the entrained proppant to enter the fractures and prop the formation structures apart, producing channels which will create highly conductive paths reaching out into the production interval, and thereby increasing the reservoir permeability in the fracture region. As such, the success of the fracture operation is dependent upon the ability to inject large volumes of hydraulic fracture fluid along the entire length of the formation at a high pressure and at a high flow rate.

It has been found, however, that it is difficult to achieve a complete gravel pack of the desired production interval either independent of or as part of a fracturing operation, particularly in long or inclined/horizontal production intervals. These incomplete packs are commonly a result of the liquid carrier entering the more permeable portions of the production interval causing the gravel to form a sand bridge in the annulus. Thereafter, the sand bridge prevents the gravel pack slurry from flowing to the remainder of the annulus which, in turn, prevents the placement of sufficient gravel in the remainder of the annulus.

Therefore a need has arisen for a screen assembly and a method that are capable of creating fractures along the entire length of a production interval. A need has also arisen for such a screen assembly and a method that can produce a complete gravel pack of the wellbore adjacent to the production interval either independent of or as part of the fracturing of the production interval. Further, a need has arisen for a screen assembly and a method that are capable of stimulating the production interval to enhance production and gravel packing the production interval to prevent the production of fine particulate materials when production commences.

SUMMARY OF THE INVENTION

The present invention disclosed herein comprises a screen assembly and a method that are capable of enhancing production from a production interval by creating fractures throughout the entire interval and producing a substantially complete gravel pack of the wellbore adjacent to the production interval to prevent the production of fine particulate materials when production commences. The screen assembly and the method of the present invention achieve these results by progressively treating the production interval from one end to the other.

The screen assembly comprises a sand control screen that is positioned within the wellbore and a plurality of diverter members positioned along the sand control screen. The diverter members progressively allow fluid communication from the interior of the screen assembly to the exterior of the screen assembly from a first end to a second end of the interval, thereby delivering the treatment fluid along the entire length of the interval.

The diverter members may comprise a plurality of actuatable members. The actuatable devices may be rupture disks, pressure actuated one-way valves or other pressure actuated devices that are positioned along the sand control screen such that the pressure required to actuate the actuatable members progressively increases from the first end to the second end of the interval. Alternatively, the actuatable members may be progressively actuated from the first end to the second end of the interval using signals sent from the surface using hard wire connections, fiber optics, hydraulics or wireless telemetry.

The sand control screen may include a base pipe having a plurality of perforation therethrough. A filter medium is positioned around the base pipe. A seal member initially prevents the flow of fluid through the perforations. The seal member may comprise propellant members that are combustibly removable. The seal member may alternatively comprise friable members that are sonically removable. As yet another alternative, the seal member may consist of a plurality of plugs, one plug for each perforation. The plugs may be chemically of mechanically removable.

The method of the present invention comprises traversing the formation with the wellbore, locating a screen assembly including a sand control screen and a plurality of diverter members within the wellbore proximate the formation, injecting a treatment fluid into the interior of the screen assembly, progressive operation the diverter members to establish fluid communication between the interior of the screen assembly and the exterior of the screen assembly from the first end to the second end of the interval and terminating the injecting when the complete interval is treated.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
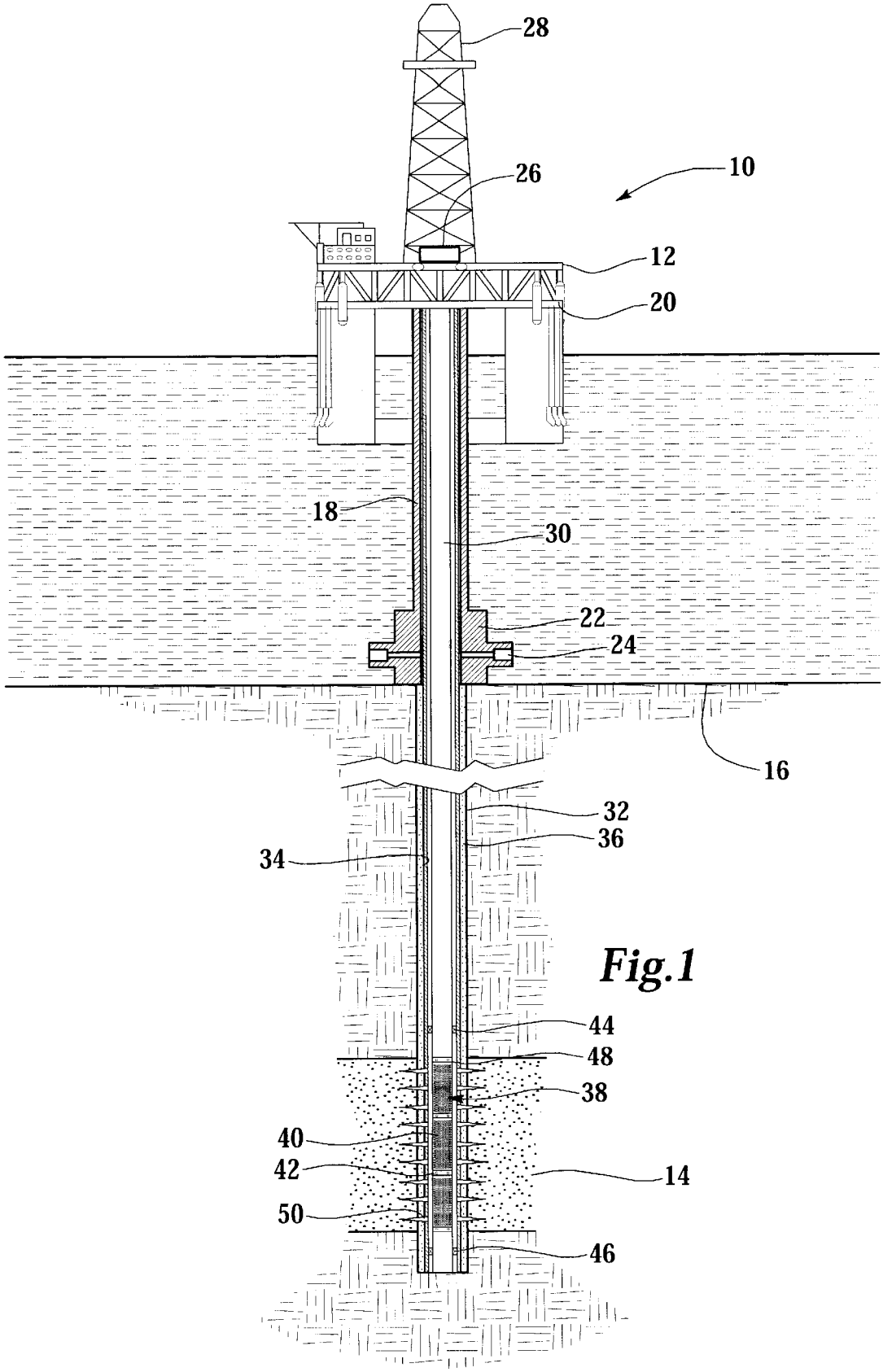
FIG. 1 is a schematic illustration of an offshore oil and gas platform operating a screen assembly having diverter members for progressively treating an interval of a wellbore of the present invention.

Referring initially to FIG. 1, a screen assembly for progressively treating an interval of a wellbore operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools including a screen assembly 38 which is positioned within wellbore 32 adjacent to formation 14. Screen assembly 38 includes a sand control screen 40 and a plurality of diverter members 42 which are used to progressively frac pack or gravel pack the production interval 48 between packers 44, 46. When it is desired to treat interval 48, work string 30 is lowered through casing 34 until screen assembly 38 is positioned adjacent to formation 14 including perforations 50. Thereafter, a treatment fluid containing sand, gravel, proppants or the like is pumped into screen assembly 38 to progressively treat interval 48.

Even though FIG. 1 depicts a vertical well, it should be noted by one skilled in the art that the screen assembly for progressively treating an interval of a wellbore of the present invention is equally well-suited for use in deviated wells, inclined wells or horizontal wells. Also, even though FIG. 1 depicts an offshore operation, it should be noted by one skilled in the art that the screen assembly for progressively treating an interval of a wellbore of the present invention is equally well-suited for use in onshore operations.

Figure 2:
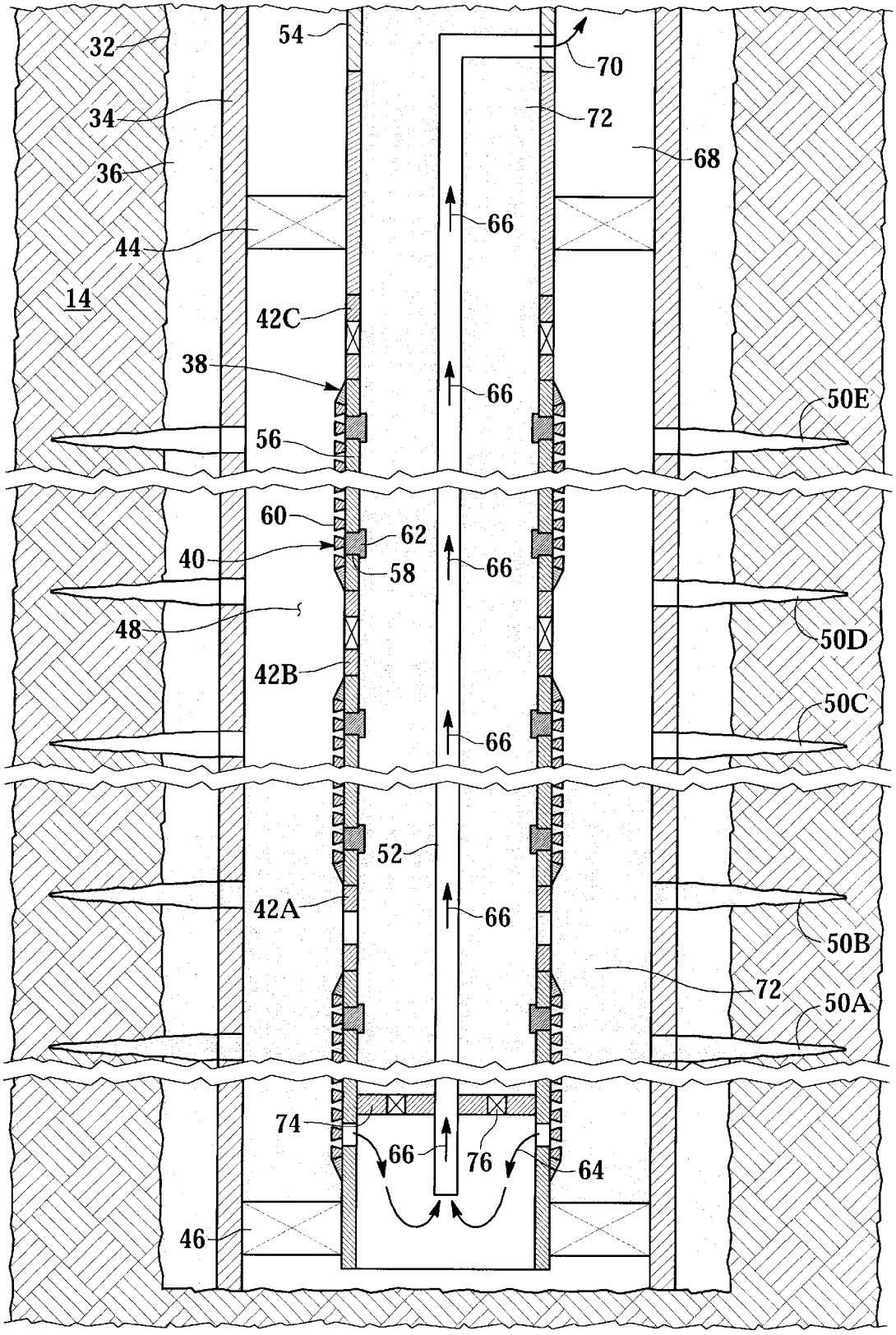
FIG. 2 is a half sectional view of a screen assembly having diverter members for progressively treating an interval of a wellbore of the present invention in its initial position during a gravel packing operation.

Referring now to FIG. 2, therein is depicted a more detailed illustration of interval 48. As illustrated, screen assembly 38 is positioned within casing 34 and is adjacent to formation 14. A wash pipe 52 is positioned within screen assembly 38. Wash pipe 52 extends into a cross-over assembly 54 which is connected to work string 30 extending from the surface. Screen assembly 38 is designed to allow fluid to flow therethrough but prevent particulate matter of sufficient size from flowing therethrough. The exact design of screen assembly 38 is not critical to the present invention as long as it is suitably designed for the characteristics of the formation fluids and the treatment fluids. For example, as illustrated, screen assembly 38 includes sand control screen 40 which is made up from a plurality of sections. Each section of sand control screen 40 has a base pipe 56 having a plurality of perforations 58. Positioned around base pipe 56 is a wire wrap screen 60. Alternatively, a plurality of ribs may be placed around the base pipe to provide stand off between the base pipe and the wire wrap. It should be noted by those skilled in the art that even though FIG. 2 has depicted a wire wrapped screen, other types of filter media could alternatively be used without departing from the principles of the present invention. For example, a fluid-porous, particulate restricting, sintered metal material such as a plurality of layers of a wire mesh that are sintered together to form a porous sintered wire mesh screen could alternatively be used. Disposed within perforations 58 are seal members depicted as plugs 62 which prevents fluid flow through perforations 58 of base pipe 56.

In the illustrated embodiment, screen assembly 38 also includes a plurality of diverter members which are designated 42A–42C. Suitable diverter members 42A–42C include valves or rupture disks in combination with valves and are preferably one-way valves that selectively allow fluid to flow from the interior of screen assembly 38 to the exterior of screen assembly 38. Diverter members 42A–42C may be progressively actuated using a variety of known techniques such as sending a signal via a direct electrical connection, fiber optics, hydraulics, wireless telemetry including pressure pulses, electromagnetic waves or acoustic signals and the like. Diverter members 42A–42C are preferably pressure actuated one-way valves as explained in more detail below.

To begin the completion process, interval 48 adjacent to formation 14 is isolated. Packer 44 seals the near end of interval 48 and packer 46 seals the far end of interval 48. Cross-over assembly 54 is located adjacent to screen assembly 38. As illustrated, when the treatment operation is a gravel pack, the objective is to uniformly and completely fill interval 48 with gravel. To help achieve this result, wash pipe 52 is disposed within screen assembly 38. Wash pipe 52 extends into cross-over assembly 54 such that return fluid passing through screen assembly 38, indicated by arrows 64, may travel through wash pipe 52, as indicated by arrows 66, and into annulus 68, as indicted by arrow 70, for return to the surface.

The fluid slurry containing gravel 72 is pumped into screen assembly 38. In the illustrated embodiment, the fluid slurry containing gravel 72 travels to the far end of interval 48 through screen assembly 38. As illustrated, the fluid slurry containing gravel 72 is prevented from exiting screen assembly 38 at closed diverter members 42C and 42B as well as by seal members 62. The fluid slurry containing gravel 72 initially exits screen assembly 38 through open diverter member 42A.

More specifically, diverter member 42A allows the fluid slurry containing gravel 72 to travel from the interior of screen assembly 38 into interval 48. As the fluid slurry containing gravel 72 enters interval 48, the gravel 72 drops out of the slurry and builds up from formation 14, filling perforations 50A–50B and interval 48 around the far section of screen assembly 38 forming the initial portion of the gravel pack. Some of the carrier fluid in the slurry may leak off through perforations 50A–50B into formation 14 while the remainder of the carrier fluid passes through the far end of screen assembly 38 beyond seal element 74, as indicated by arrows 64, that is sized to prevent gravel 72 from flowing therethrough. The fluid flowing back through screen assembly 38, as explained above, follows the paths indicated by arrows 66, 70 back to the surface.

Figure 3:
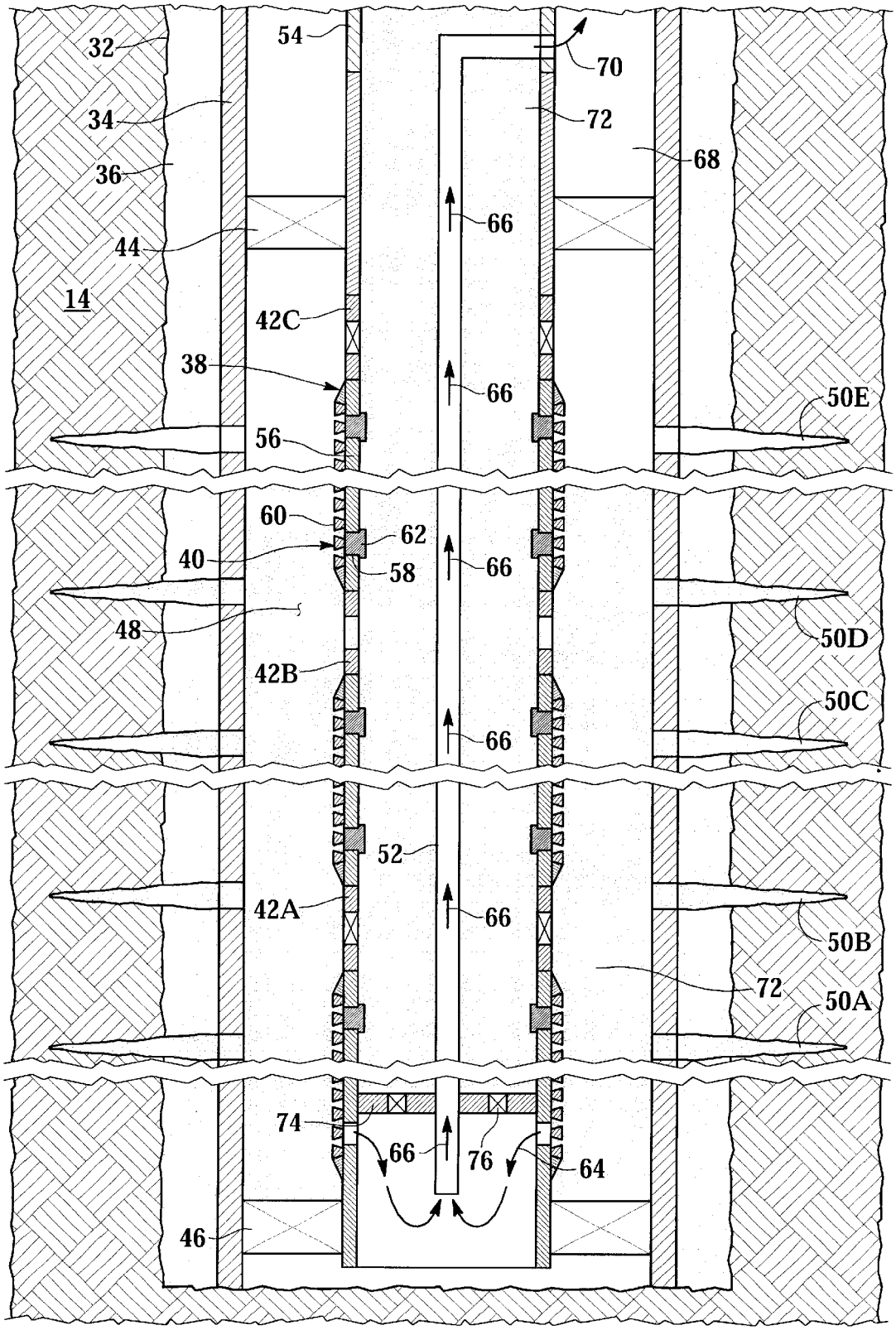
FIG. 3 is a half sectional view of a screen assembly having diverter members for progressively treating an interval of a wellbore of the present invention after gravel packing an initial portion of the interval.

As the initial portion of the gravel pack becomes tightly packed, the pressure in screen assembly 38 increases. At this point and as best seen in FIG. 3, diverter member 42B is actuated which allows the fluid slurry containing gravel 72 to travel from the interior of screen assembly 38 into interval 48 through diverter member 42B. In addition, also as seen in FIG. 3, diverter member 42A is closed. For example, in embodiments wherein diverter members 42 are one-way valves, when the gravel pack progresses from formation 14 to a diverter member, that diverter member will seal to prevent progression back into screen assembly 38. Likewise, in embodiments wherein diverter members 42 are controlled by signals sent from the surface, each diverter member may be sequentially closed. As the fluid slurry containing gravel 72 enters interval 48 through diverter member 42B, the gravel 72 drops out of the slurry and builds up from formation 14, filling perforations 50C–50D and interval 48 around the adjacent section of screen assembly 38 forming the next portion of the gravel pack. While some of the carrier fluid in the slurry may leak off through perforations 50C–50D into formation 14, the remainder of the carrier fluid passes through the far end of screen assembly 38, as indicated by arrows 64 and returns to the surface as indicated by arrows 66, 70.

Figure 4:
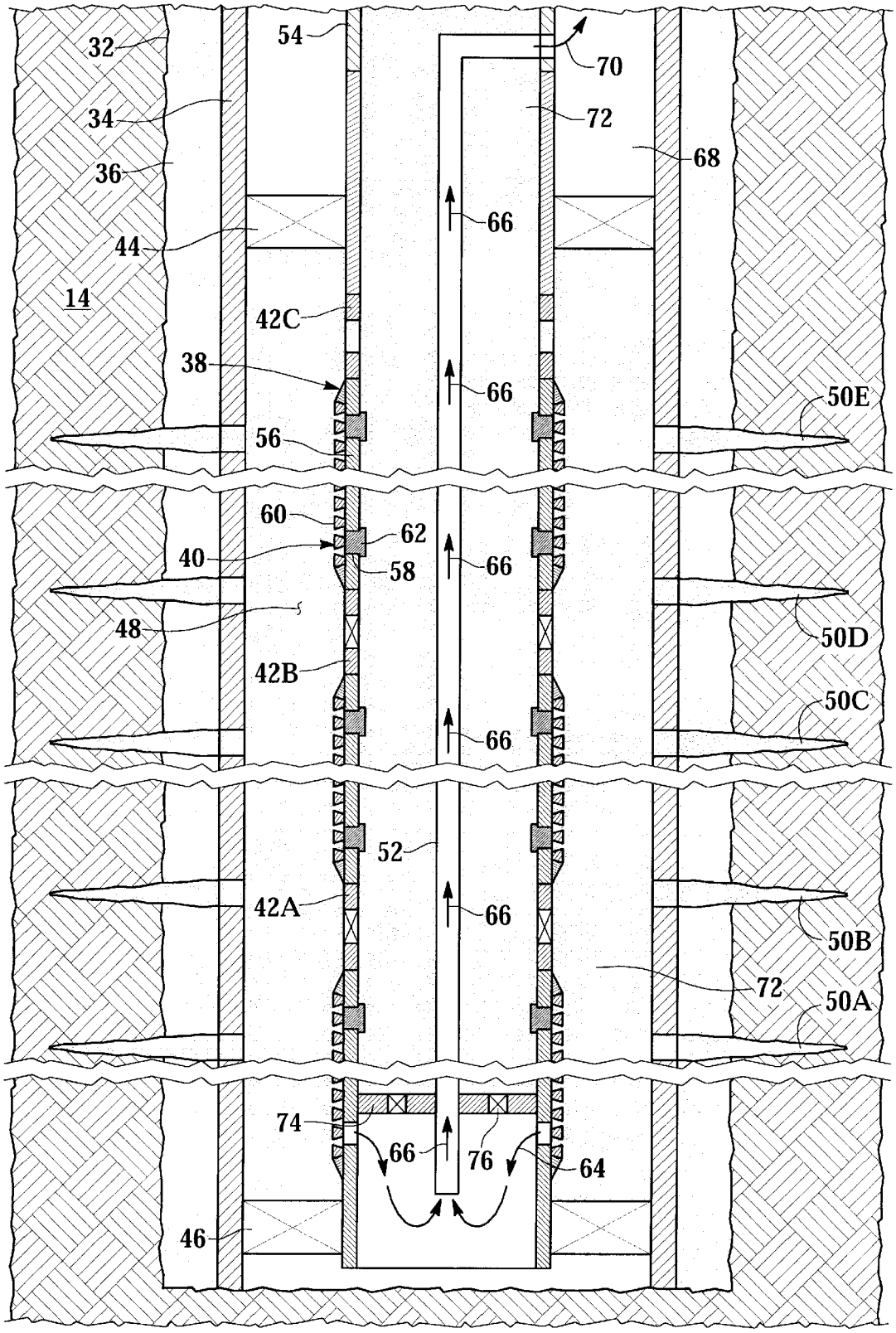
FIG. 4 is a half sectional view of a screen assembly having diverter members for progressively treating an interval of a wellbore of the present invention gravel packing the last portion of the interval.

This process continues from the far end of interval 48 to the near end of interval 48. Specifically, as this portion of the gravel pack becomes tightly packed one or more diverter members 42 closes and the pressure in screen assembly 38 again increases causing the next diverter members 42 in the progression to open. As best seen in FIG. 4, when the last diverter member, diverter member 42C, is actuated, the fluid slurry containing gravel 72 travels from the interior of screen assembly 38 into interval 48 through diverter member 42C and diverter member 42B is closed. As the fluid slurry containing gravel 72 enters interval 48 through diverter member 42C, the gravel 72 drops out of the slurry and builds up from formation 14, filling perforation 50E and interval 48 around the near section of screen assembly 38, thereby forming the last portion of the gravel pack. While some of the carrier fluid in the slurry may leak off through perforation 50E into formation 14, the remainder of the carrier fluid passes through the far end of screen assembly 38, as indicated by arrows 64 and returns to the surface as indicated by arrows 66, 70.

As can be seen, using the present invention for progressively treating an interval of a wellbore, a gravel pack may progress from one end of an interval toward the other end of an interval as fluid communication is progressively established along the entire length of the interval. Also, as should be apparent to those skilled in the art, even though FIGS. 2–4 present the progressive gravel packing of an interval of a wellbore in a vertical orientation with packer 44 at the top of interval 48 and packer 46 at the bottom of interval 48, these figures are intended to also represent wellbores that have alternate directional orientations such as inclined wellbores and horizontal wellbores. In the horizontal orientation, for example, packer 44 is at the heel of interval 48 and packer 46 is at the toe of interval 48.

Likewise, even though FIGS. 2–4 present the progressive gravel packing of an interval of a wellbore as being progressively performed from the far end of the interval to the near end of the interval, those skilled in the art will understand that the progressive gravel packing process of the present invention can alternatively be performed from the near end of the interval to the far end of the interval.

As stated above, there are numerous ways to progressively actuate diverter members 42A–42C. In the preferred method described above, the pressure created by the fluid slurry within screen assembly 38 progressively triggers the actuation of diverter members 42A–42C. One way to implement this method is to position diverter members 42A–42C along screen assembly 38 such that the pressure required to actuate diverter members 42A–42C progressively increases from one end of interval 48 to the other end of interval 48. For example, each adjacent diverter member may be set to actuate at an incremental pressure above the prior diverter members such as at increments of between about 50–100 psi. This assures a proper progression of the gravel pack by preventing any out of sequence activations. In addition, this approach is particularly advantageous in that the incremental pressure increase of adjacent diverter members helps to insure that each section of the gravel pack is tightly packed prior to initiating the gravel packing of subsequent sections.

Alternatively, a hard wired or wireless telemetry system may be used to progressively actuate diverter members 42A–42C. For example, each diverter member may be actuated by sending a signal from the surface addressed to a specific diverter member. This assures a proper progression of the gravel pack by preventing any out of sequence activations. The signals may be manually or automatically sent based upon time or the pressure response in screen assembly 38. For example, the signal to actuate the next diverter member may be sent each time the pressure within screen assembly 38 reaches a particular level or each time the pressure within screen assembly 38 reaches the next preselected pressure increment. As with the direct pressure response method, the particular actuation sequence should insure that each section of the gravel pack is tightly packed prior to initiating the gravel packing of subsequent sections.

Figure 5:
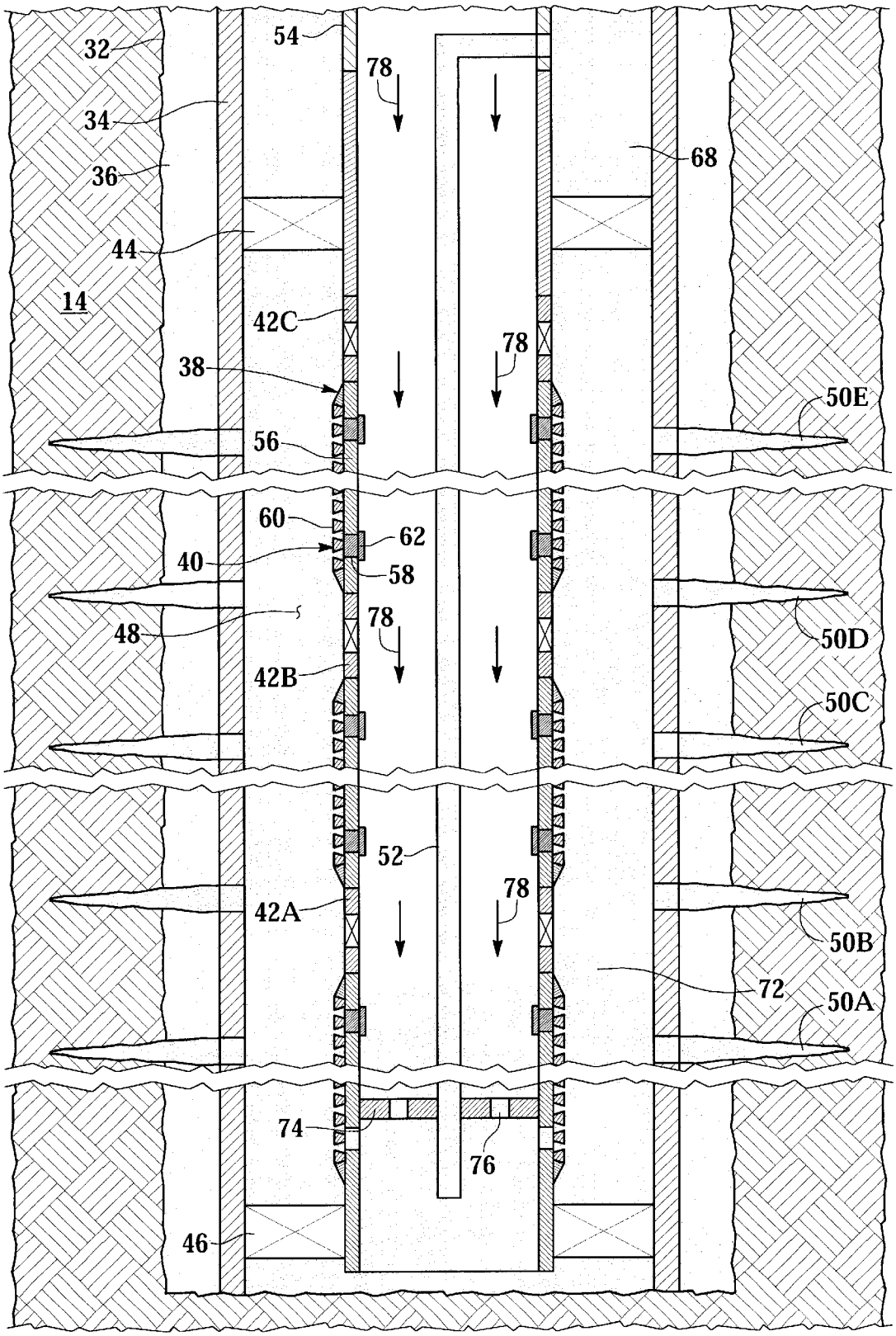
FIG. 5 is a half sectional view of a screen assembly having diverter members for progressively treating an interval of a wellbore of the present invention in its reverse out configuration following a gravel packing operation.

After interval 48 is completely packed with gravel 72, an amount of gravel 72 remains in screen assembly 38 and must be removed. As best seen in FIG. 5, this is achieved by opening ports 76 in seal element 74. Once ports 76 are opened, a fluid represented by arrows 78 is pumped into screen assembly 38 which reverses out gravel 72 from work string 30 and screen assembly 38. Specifically, gravel 72 passes through seal element 74 via ports 76 then enters wash pipe 52. Once in wash pipe 52, gravel 72 travels to annulus 68 and back to the surface. Accordingly, the interior of screen assembly 38 is washed.

Following the reverse out process, seal members 62 must be removed from base pipe 56. The technique used to remove seal members 62 will depend upon the construction of seal members 62. For example, in the illustrated embodiment, seal members 62 comprise a plurality of plugs. If the plugs are formed from an acid reactive material such as aluminum, an acid treatment may be used to remove the plugs. The acid may be pumped into the interior of screen assembly 38 where it will react with the reactive plugs, thereby chemically removing seal members 62. The acid may be returned to the surface via wash pipe 52 and annulus 68.

Alternatively, seal members 62 may be mechanically removed. For example, seal element 74 may be used to physically contact seal members 62 and remove seal members 62 from perforations 58 as wash pipe 52 and seal element 74 are removed from the interior of screen assembly 38. As another alternative, if seal members 62 are constructed from propellants, a combustion process may be used to remove seal members 62. Likewise, if seal members 62 are constructed from friable materials such as ceramics, a vibration process, such as sonic vibrations may be used to remove seal members 62. It should be understood by those skilled in the art that other types of seal members 62 may be used to temporarily prevent fluid flow through screen assembly 38 which may be removed by other types of removal processes without departing from the principles of the present invention.

Figure 6:
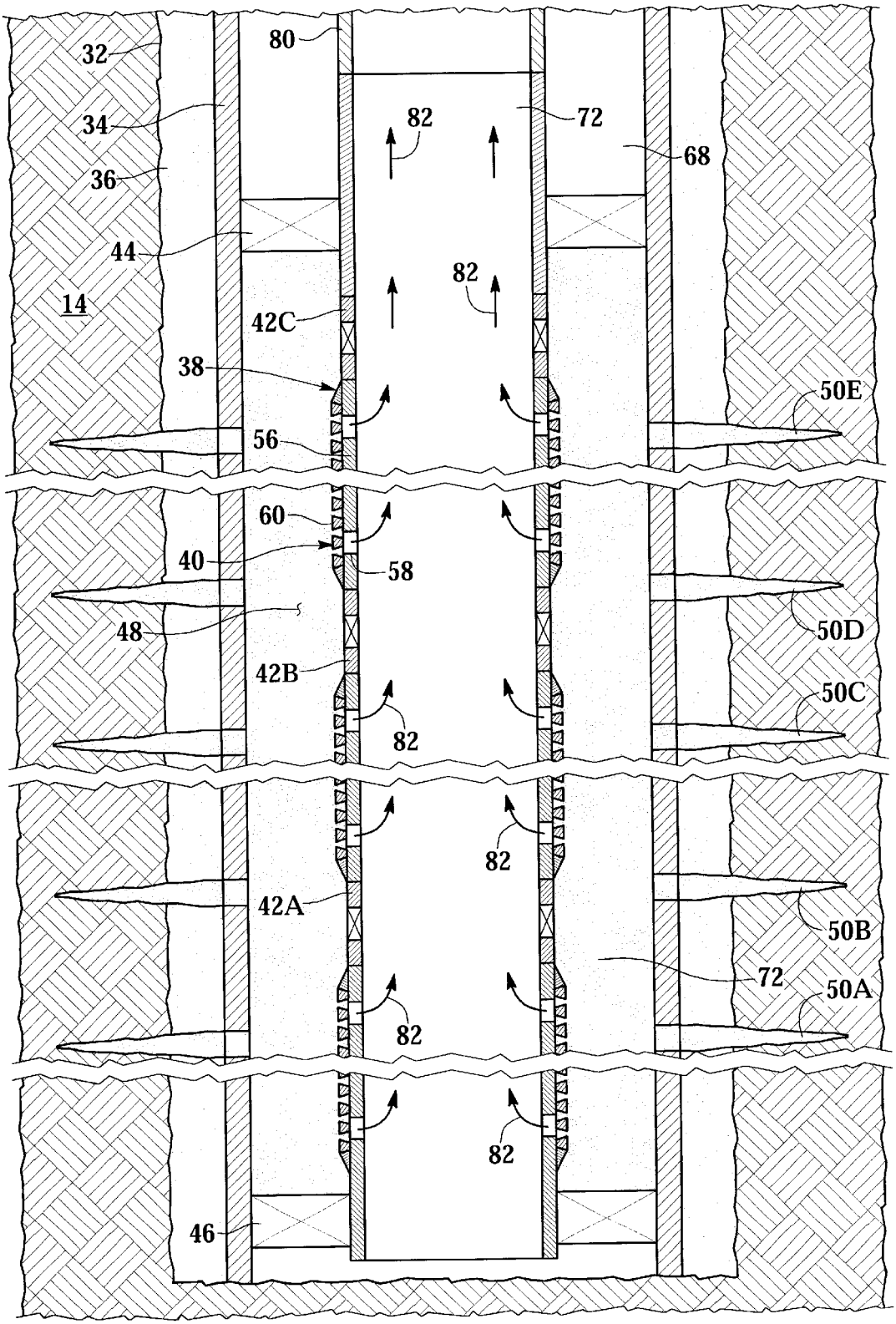
FIG. 6 is a half sectional view of a screen assembly having diverter members for progressively treating an interval of a wellbore of the present invention in its production configuration following a gravel packing operation.

Once the interior of screen assembly 38 has been washed, seal members 62 have been removed and wash pipe 52 has been retrieved, tubing 80 may be coupled to screen assembly 38, as best seen in FIG. 6. Thereafter, the production of formation fluids represented by arrows 82 may commence. As illustrated, formation fluids 82 enter the interior of screen assembly 38 via perforations 58. Prior to traveling through perforations 58, formation fluids 82 pass through screen 60 and the gravel pack surrounding screen assembly 38. Accordingly, any particulate in formation fluids 82 is filtered out. Importantly, no formation fluids enter the interior of screen assembly 38 via diverter members 42. Following the gravel packing operation, all diverter members 42 are closed. Preferably, as explained above, diverter members 42 comprise one-way valves designed to allow fluid flow from the interior of screen assembly 38 to the exterior of screen assembly 38 but not from the exterior of screen assembly 38 to the interior of screen assembly 38. Accordingly, formation fluids 82 do not travel through diverter members 42 but instead enter screen assembly 38 only through perforations 58.

Figure 7:
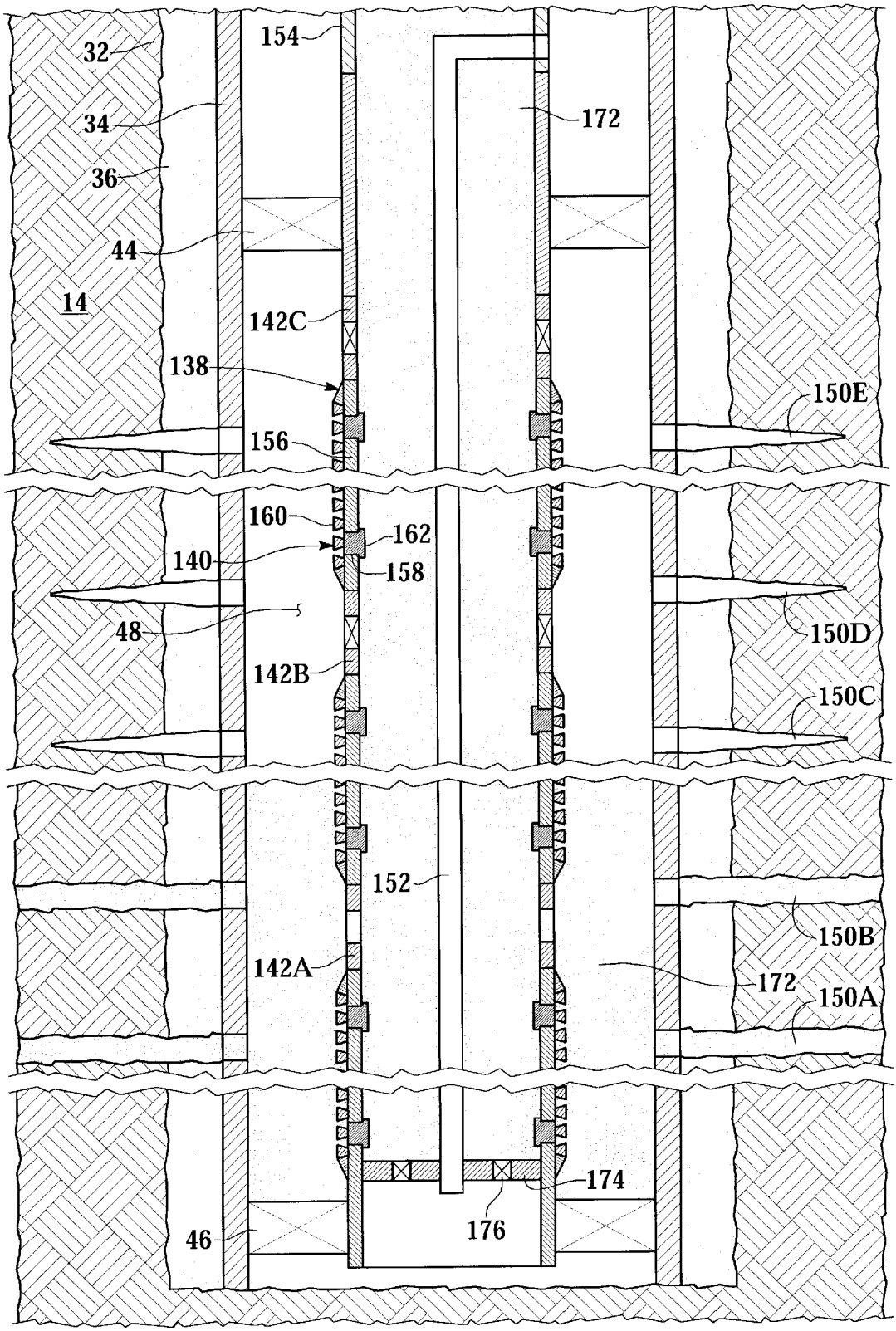
FIG. 7 is a half sectional view of a screen assembly having diverter members for progressively treating an interval of a wellbore of the present invention in its initial position during a fracture operation.

Referring now to FIG. 7, therein is depicted another embodiment of the present invention that is used for frac packing interval 48. As illustrated, screen assembly 138 including sand control screen 140 and diverter members 142, is positioned within casing 34 and is adjacent to formation 14. A wash pipe 152 is positioned within screen assembly 138. Wash pipe 152 extends into a cross-over assembly 154 which is connected to work string 30 extending from the surface. As illustrated, sand control screen 140 has a plurality of sections each including base pipe 156 having perforations 158. A wire wrap screen 160 is positioned around base pipe 156. Seal members 162 are positioned within perforations 158 to initially prevent fluid flow therethrough.

Diverter members 142A–142C are preferable valves, such as pressure actuated one-way valves that selectively allow fluid to flow from the interior of screen assembly 138 to the exterior of screen assembly 138. As explained above, diverter members 142A–142C may alternatively be progressively actuated using a variety of known techniques such as sending a signal via a hard wire connection, fiber optics, hydraulics, wireless telemetry including pressure pulses, electromagnetic waves or acoustic signals and the like.

To begin the completion process, interval 48 adjacent to formation 14 is isolated. Packer 44 seals the near end of interval 48 and packer 46 seals the far end of interval 48. As illustrated, when the treatment operation is a frac pack, the objective is to enhance the permeability of formation 14 by delivering a fluid slurry containing proppants 172 at a high flow rate and in a large volume above the fracture gradient of formation 14 such that fractures may be formed within formation 14 and held open by the proppants 172. In addition, a frac pack also has the objective of preventing the production of fines by packing interval 48 with the proppants 172.

The fluid slurry containing proppants 172 is pumped into screen assembly 138. In the illustrated embodiment, the fluid slurry containing proppants 172 travels to the far end of interval 48 through screen assembly 138 and exit through diverter member 142A. As the fluid slurry containing proppants 172 is being delivered at a high flowrate and in a large volume above the fracture gradient of formation 14 and as no returns are being taken, the fluid slurry fractures formation 14 as indicated by fracture 150A–150B. When the fractures cease to propagate further into formation 14, the portion of interval 48 adjacent to this section of screen assembly 138 begins to screen out. The pressure within screen assembly 138 will rise causing the progressive actuation of diverter members 142 in the manner described above with reference to FIGS. 2–4. It should be noted that as the frac pack operation progresses, some of the proppants 172 in the fluid slurry will remain in interval 48, thereby packing interval 48 around screen assembly 138. Following the frac pack operation, the interior of screen assembly 138 is washed, seal members 162 are removed and wash pipe 152 is retrieved as described above.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A screen assembly for progressively treating an interval of a wellbore comprising:

a sand control screen positioned within the interval of the wellbore; and a plurality of diverter members positioned along the sand control screen, the diverter members progressively allowing fluid communication from an interior of the sand control screen to an exterior of the sand control screen from a first end of the interval to a second end of the interval.

2. The screen assembly as recited in claim 1 wherein the diverter members further comprise a plurality of actuatable members positioned along the sand control screen.

3. The screen assembly as recited in claim 2 wherein the actuatable members further comprise rupture disks that are positioned along the sand control screen such that the pressure required to actuate the rupture disks progressively increases from the first end to the second end of the interval.

4. The screen assembly as recited in claim 2 wherein the actuatable members further comprise pressure actuated one-way valves that are positioned along the sand control screen such that the pressure required to actuate the pressure actuated one-way valves progressively increases from the first end to the second end of the interval.

5. The screen assembly as recited in claim 2 wherein the actuatable members further comprise one-way valves that are progressively actuated from the first end to the second end of the interval in response to signals.

6. The screen assembly as recited in claim 2 wherein the actuatable members further comprise rupture disks and one-way valves that are positioned along the sand control screen such that the pressure required to actuate the rupture disks progressively increases from the first end to the second end of the interval.

7. The screen assembly as recited in claim 1 wherein the sand control screen further comprises a base pipe having perforations, a filter medium disposed around the base pipe and a seal member that prevents the flow of fluid through the perforations.

8. The screen assembly as recited in claim 7 wherein the seal member further comprises a plurality of propellant members that are combustibly removable from the base pipe.

9. The screen assembly as recited in claim 7 wherein the seal member further comprises a plurality of friable members that are sonically removable from the base pipe.

10. The screen assembly as recited in claim 7 wherein the seal member further comprises plugs that are chemically removable from the base pipe.

11. The screen assembly as recited in claim 7 wherein the seal member further comprises plugs that are mechanically removable from the base pipe.

12. The screen assembly as recited in claim 1 wherein the first end is closer to a far end of the wellbore than the second end.

13. The screen assembly as recited in claim 1 wherein the first end is closer to a near end of the wellbore than the second end.

14. A screen assembly for progressively treating an interval of a wellbore comprising:

a sand control screen positioned within the interval of the wellbore; and a plurality of pressure actuated one-way valves positioned along the sand control screen, the pressure actuated one-way valves progressively allowing fluid communication from an interior of the sand control screen to an exterior of the sand control screen from a first end of the interval to a second end of the interval as the pressure created by a treatment fluid pumped into the interior of the sand control screen progressively increases from the first end of the interval to the second end of the interval.

15. The screen assembly as recited in claim 14 wherein the sand control screen further comprises a base pipe having perforations, a filter medium disposed around the base pipe and a seal member that prevents the flow of fluid through the perforations.

16. The screen assembly as recited in claim 15 wherein the seal member further comprises a plurality of propellant members that are combustibly removable from the base pipe.

17. The screen assembly as recited in claim 15 wherein the seal member further comprises a plurality of friable members that are sonically removable from the base pipe.

18. The screen assembly as recited in claim 15 wherein the seal member further comprises plugs that are chemically removable from the base pipe.

19. The screen assembly as recited in claim 15 wherein the seal member further comprises plugs that are mechanically removable from the base pipe.

20. The screen assembly as recited in claim 14 wherein the first end is closer to a far end of the wellbore than the second end.

21. The screen assembly as recited in claim 14 wherein the first end is closer to a near end of the wellbore than the second end.

22. A screen assembly for progressively treating an interval of a wellbore comprising:

a sand control screen positioned within the interval of the wellbore, the sand control screen having a base pipe with perforations, a filter medium disposed around the base pipe and a seal member that prevents the flow of fluid through the perforations; and a plurality of diverter members positioned along the sand control screen, the diverter members progressively allowing fluid communication from an interior of the sand control screen to an exterior of the sand control screen from a first end of the interval to a second end of the interval.

23. The screen assembly as recited in claim 22 wherein the diverter members further comprise a plurality of actuatable members positioned along the sand control screen.

24. The screen assembly as recited in claim 23 wherein the actuatable members further comprise rupture disks that are positioned along the sand control screen such that the pressure required to actuate the rupture disks progressively increases from the first end to the second end of the interval.

25. The screen assembly as recited in claim 23 wherein the actuatable members further comprise pressure actuated one-way valves that are positioned along the sand control screen such that the pressure required to actuate the pressure actuated one-way valves progressively increases from the first end to the second end of the interval.

26. The screen assembly as recited in claim 23 wherein the actuatable members further comprise one-way valves that are progressively actuated from the first end to the second end of the interval in response to signals.

27. The screen assembly as recited in claim 23 wherein the actuatable members further comprise rupture disks and one-way valves that are positioned along the sand control screen such that the pressure required to actuate the rupture disks progressively increases from the first end to the second end of the interval.

28. The screen assembly as recited in claim 22 wherein the seal member further comprises a plurality of propellant members that are combustibly removable from the base pipe.

29. The screen assembly as recited in claim 22 wherein the seal member further comprises a plurality of friable members that are sonically removable from the base pipe.

30. The screen assembly as recited in claim 22 wherein the seal member further comprises plugs that are chemically removable from the base pipe.

31. The screen assembly as recited in claim 22 wherein the seal member further comprises plugs that are mechanically removable from the base pipe.

32. The screen assembly as recited in claim 22 wherein the first end is closer to a far end of the wellbore than the second end.

33. The screen assembly as recited in claim 22 wherein the first end is closer to a near end of the wellbore than the second end.

34. A screen assembly for progressively treating an interval of a wellbore comprising:

a sand control screen positioned within the interval of the wellbore, the sand control screen having a base pipe with perforations, a filter medium disposed around the base pipe and a seal member that prevents the flow of fluid through the perforations; and a plurality of pressure actuated one-way valves positioned along the sand control screen, the pressure actuated one-way valves progressively allowing fluid communication from an interior of the sand control screen to an exterior of the sand control screen from a first end of the interval to a second end of the interval as the pressure created by a treatment fluid pumped into the interior of the sand control screen progressively increases from the first end of the interval to the second end of the interval.

35. A method for progressively treating an interval of a wellbore, the method comprising the steps of:

traversing a formation with the wellbore;

locating a screen assembly within the wellbore proximate the formation, the screen assembly including a sand control screen and a plurality of diverter members positioned along the sand control screen;

injecting a treatment fluid into the interior of the screen assembly;

progressively operating the diverter members to establish fluid communication between the interior of the screen assembly and the exterior of the screen assembly from a first end to a second end of the interval; and terminating the injecting when the interval is treated.

36. The method as recited in claim 35 wherein the step of progressively operating the diverter members further comprises progressively operating a plurality of pressure actuatable members.

37. The method as recited in claim 35 wherein the step of progressively operating the diverter members further comprises progressively operating a plurality of rupture disks.

38. The method as recited in claim 35 wherein the step of progressively operating the diverter members further comprises progressively operating a plurality of pressure actuatable one-way valves.

39. The method as recited in claim 35 wherein the step of progressively operating the diverter members further comprises progressively operating a plurality of one-way valves from the first end to the second end in response to signals.

40. The method as recited in claim 35 further comprising the step of preventing the flow of fluid through perforations in a base pipe of the sand control screen with a seal member.

41. The method as recited in claim 40 further comprising the step of combustibly removing the seal member from the base pipe.

42. The method as recited in claim 40 further comprising the step of sonically removing the seal member from the base pipe.

43. The method as recited in claim 40 further comprising the step of chemically removing the seal member from the base pipe.

44. The method as recited in claim 40 further comprising the step of mechanically removing the seal member from the base pipe.

45. The method as recited in claim 35 wherein the step of progressively operating the diverter members to establish fluid communication between the interior of the screen assembly and the exterior of the screen assembly from a first end to a second end of the interval further comprises positioning the first end closer to the far end of the wellbore than the second end.

46. The method as recited in claim 35 wherein the step of progressively operating the diverter members to establish fluid communication between the interior of the screen assembly and the exterior of the screen assembly from a first end to a second end of the interval further comprises positioning the first end closer to the near end of the wellbore than the second end.

47. A method for progressively treating an interval of a wellbore, the method comprising the steps of:

traversing a formation with the wellbore;

locating a screen assembly within the wellbore proximate the formation, the screen assembly including a sand control screen and a plurality of pressure actuated one-way valves positioned along the sand control screen;

injecting a treatment fluid into the interior of the screen assembly;

progressively operating the pressure actuated one-way valves to establish fluid communication between the interior of the screen assembly and the exterior of the screen assembly from a first end to a second end of the interval; and terminating the injecting when the interval is treated.

48. The method as recited in claim 47 further comprising the step of preventing the flow of fluid through perforations in a base pipe of the sand control screen with a seal member.

49. The method as recited in claim 48 further comprising the step of combustibly removing the seal member from the base pipe.

50. The method as recited in claim 48 further comprising the step of sonically removing the seal member from the base pipe.

51. The method as recited in claim 48 further comprising the step of chemically removing the seal member from the base pipe.

52. The method as recited in claim 48 further comprising the step of mechanically removing the seal member from the base pipe.

53. The method as recited in claim 47 wherein the step of progressively operating the diverter members to establish fluid communication between the interior of the screen assembly and the exterior of the screen assembly from a first end to a second end of the interval further comprises positioning the first end closer to the far end of the wellbore than the second end.

54. The method as recited in claim 47 wherein the step of progressively operating the diverter members to establish fluid communication between the interior of the screen assembly and the exterior of the screen assembly from a first end to a second end of the interval further comprises positioning the first end closer to the near end of the wellbore than the second end.

55. A method for progressively treating an interval of a wellbore, the method comprising the steps of:

traversing a formation with the wellbore;

locating a screen assembly within the wellbore proximate the formation, the screen assembly including a sand control screen having a base pipe with perforations and a filter medium disposed thereon and a plurality of diverter members positioned along the sand control screen;

injecting a treatment fluid into the interior of the screen assembly;

preventing the flow of fluid through the perforations in the base pipe with a seal member;

progressively operating the diverter members to establish fluid communication between the interior of the screen assembly and the exterior of the screen assembly front a first end to a second end of the interval; and terminating the injecting when the interval is treated.

56. The method as recited in claim 55 wherein the step of progressively operating the diverter members further comprises progressively operating a plurality of rupture disks.

57. The method as recited in claim 55 wherein the step of progressively operating the diverter members further comprises progressively operating a plurality of pressure actuatable one-way valves.

58. The method as recited in claim 55 wherein the step of progressively operating the diverter members further comprises progressively operating a plurality of one-way valves from the first end to the second end in response to signals.

59. The method as recited in claim 55 further comprising the step of combustibly removing the seal member from the base pipe.

60. The method as recited in claim 55 further comprising the step of sonically removing the seal member from the base pipe.

61. The method as recited in claim 55 further comprising the step of chemically removing the seal member from the base pipe.

62. The method as recited in claim 55 further comprising the step of mechanically removing the seal member from the base pipe.

63. The method as recited in claim 55 wherein the step of progressively operating the diverter members to establish fluid communication between the interior of the screen assembly and the exterior of the screen assembly from a first end to a second end of the interval further comprises positioning the first end closer to the far end of the wellbore than the second end.

64. The method as recited in claim 55 wherein the step of progressively operating the diverter members to establish fluid communication between the interior of the screen assembly and the exterior of the screen assembly from a first end to a second end of the interval further comprises positioning the first end closer to the near end of the wellbore than the second end.

* * * * *